US005971338A

United States Patent [19]

Olsen et al.

[11] Patent Number: 5,971,338

[45] Date of Patent: Oct. 26, 1999

[54] METHOD AND APPARATUS FOR SECURING INDUCTION COILS IN AN INDUCTION FURNACE

[75] Inventors: Gordon L. Olsen, Pleasant Grove; Thad N. Beal, Lehi, both of Utah

[73] Assignee: Olsen-Beal Associates, Lindon, Utah

[21] Appl. No.: 08/799,708

[22] Filed: Feb. 13, 1997

[51] Int. Cl.[6] ..... H05B 6/22

[52] U.S. Cl. ..... 248/317; 373/153

[58] Field of Search ..... 248/317, 340, 248/610, 613, 612, 589, 58, 62, 560, 611; 373/153

[56] References Cited

U.S. PATENT DOCUMENTS

| | | | |
|---|---|---|---|
| 1,342,787 | 6/1920 | White | 439/462 |
| 2,753,391 | 7/1956 | Northup | 174/62 |
| 2,852,587 | 9/1958 | Junker | 373/153 |
| 3,004,091 | 10/1961 | Tama et al. | 373/153 |
| 3,168,252 | 2/1965 | Cabernoch | 362/404 |
| 3,639,752 | 2/1972 | Appleton | 174/61 |
| 3,944,715 | 3/1976 | Hegewaldt et al. | 373/153 |
| 4,060,692 | 11/1977 | Naastepad et al. | 373/153 |
| 4,079,222 | 3/1978 | Scheffler | 219/658 |
| 4,240,602 | 12/1980 | McDonald | 248/58 |
| 5,416,794 | 5/1995 | Cignetti et al. | 373/153 |
| 5,887,019 | 3/1999 | Swanger | 373/153 |

*Primary Examiner*—Ramon O. Ramirez
*Assistant Examiner*—Anita M. King
*Attorney, Agent, or Firm*—Mallinckrodt & Mallinckrodt

[57] ABSTRACT

The failure rate of the mounting structure for mounting the induction coil modules in an induction furnace is reduced by replacing the normal rigid supporting rods used to secure the induction coil modules to the furnace housing or frame with flexible mounting members. The flexible mounting members include a length of flexible material such as steel cable. Apparatus, such as a threaded rod, for securing the mounting member to the furnace housing is secured, as by swedging, to one end of the flexible material. Apparatus, such as a clevis, for securing the mounting member to the induction coil module is secured, as by swedging, to the other end of the flexible material.

15 Claims, 5 Drawing Sheets

METHOD AND APPARATUS FOR SECURING INDUCTION COILS IN AN INDUCTION FURNACE

BACKGROUND OF THE INVENTION

1. Field

This invention is in the field of suspending an electrical coil module of an induction furnace in the induction furnace.

2. State of the Art

Induction furnaces are used for many purposes, the main function being heating slab, plate, or ingot steel in steel mills world wide. The furnace can be of many shapes to encompass the size of shapes being heated. The steel shape, generally a slab, plate, or ingot, is run down a roll line where the induction furnace is installed so they pass through the induction coils of the furnace. These slabs, plates, or ingots have cooled down after initial manufacture or casting and must be brought up to a higher temperature in order to facilitate additional manufacturing processes such as rolling, bending, shearing, coiling, etc. The temperature of these pieces must be increased very quickly. This is done inside the induction furnace as each piece proceeds along the roll line through the induction coils inside the furnace. Extreme heat is generated by inducing electrical currents in the steel slab, plate, or ingot by introducing large amount of electrical current into the induction coils via high capacity electrical connections. The coils are supported in coil modules in a furnace housing by rigid support rods secured between the coil modules and the housing. Generally there is a spring mounting of the rods to the furnace housing to absorb vibration.

During the heating process, the coils of the induction furnace are subject to a great amount of vibration caused by cycling of the electrical current. In newer high power furnaces this vibration causes breakage to occur in the support rods connecting the coil modules to the furnace housing and support frame. This breakage occurs after repeated use and usually when one connection fails others will follow until total collapse of an induction coil module occurs resulting in down time of the furnace as well as the whole steel mill roll line and accompanying production capacity. The furnace must be turned off and the induction coil module that has failed removed for immediate rebuilding involving high cost and 24 hour crew loadings. Often times adjacent induction coil modules are also found to be in a state of failure resulting in additional down time and loss of revenue. There is no reliable way to detect or forecast a failure to the connection mechanism of the coil modules to the furnace housing due to massive layers of insulation and sprayed on coating over the modules after the mechanical connections are made during manufacture or repair. Failure is only detected by operators detecting a different sound or by the loose module shorting out and shutting down the system. The operator then has to determine which coil or coils have failed and remove them from the system for repair. Investigation of the failed connections in one steel mill reveals that stress cracking occurs in various places including the support rods and the fasteners securing the support rods to the induction coils. Various remedies have been tried with little appreciable improvement including heavier fasteners, different grades of steel support rods, and varying the electrical current and the on and off cycles of the coils.

SUMMARY OF THE INVENTION

According to the invention, the rigid rods used to support the induction coils of an induction furnace within the frame and housing of the furnace are replaced with flexible supporting members. The flexible supporting members preferably each include a length of cable. The flexibility of the cable absorbs vibration of the induction coils to relieve stress on the connections to the coils and the housing to thereby significantly reduce failure of the induction coil module supports and thereby down time of the furnace and maintenance costs for the furnace. A preferred supporting member includes a length of steel cable with a swedged threaded rod on one end and a swedged clevis on the other end. The clevis may be secured to a bracket extending from the coil module by a pin extending through the clevis and a receiving hole in the bracket. The threaded rod connects the supporting member to the housing, such as through a layered elastomeric washer placed between a nut on the threaded rod and the furnace housing. The elastomeric washer can be used to provide further vibration damping, if necessary or desired.

THE DRAWINGS

The best mode presently contemplated for carrying out the invention illustrated in the accompanying drawings, in which:

FIG. 1 is a somewhat schematic and fragmentary perspective view of the inside of an induction furnace showing the roll line and two induction coil modules;

FIG. 2, a transverse vertical section through a prior art induction furnace showing an induction coil in elevation;

FIG. 3, a fragmentary longitudinal vertical section taken on the line 3—3 of FIG. 2;

FIG. 4, a fragmentary longitudinal vertical section showing a support rod mounting for the coil module with a prior art support rod shown in elevation;

FIG. 5, a fragmentary transverse vertical section showing a supporting member of the invention in elevation; and FIG. 6, a fragmentary longitudinal vertical section showing the supporting member of the invention of FIG. 5 in elevation.

DETAILED DESCRIPTION OF THE ILLUSTRATED EMBODIMENT

Figure 1:
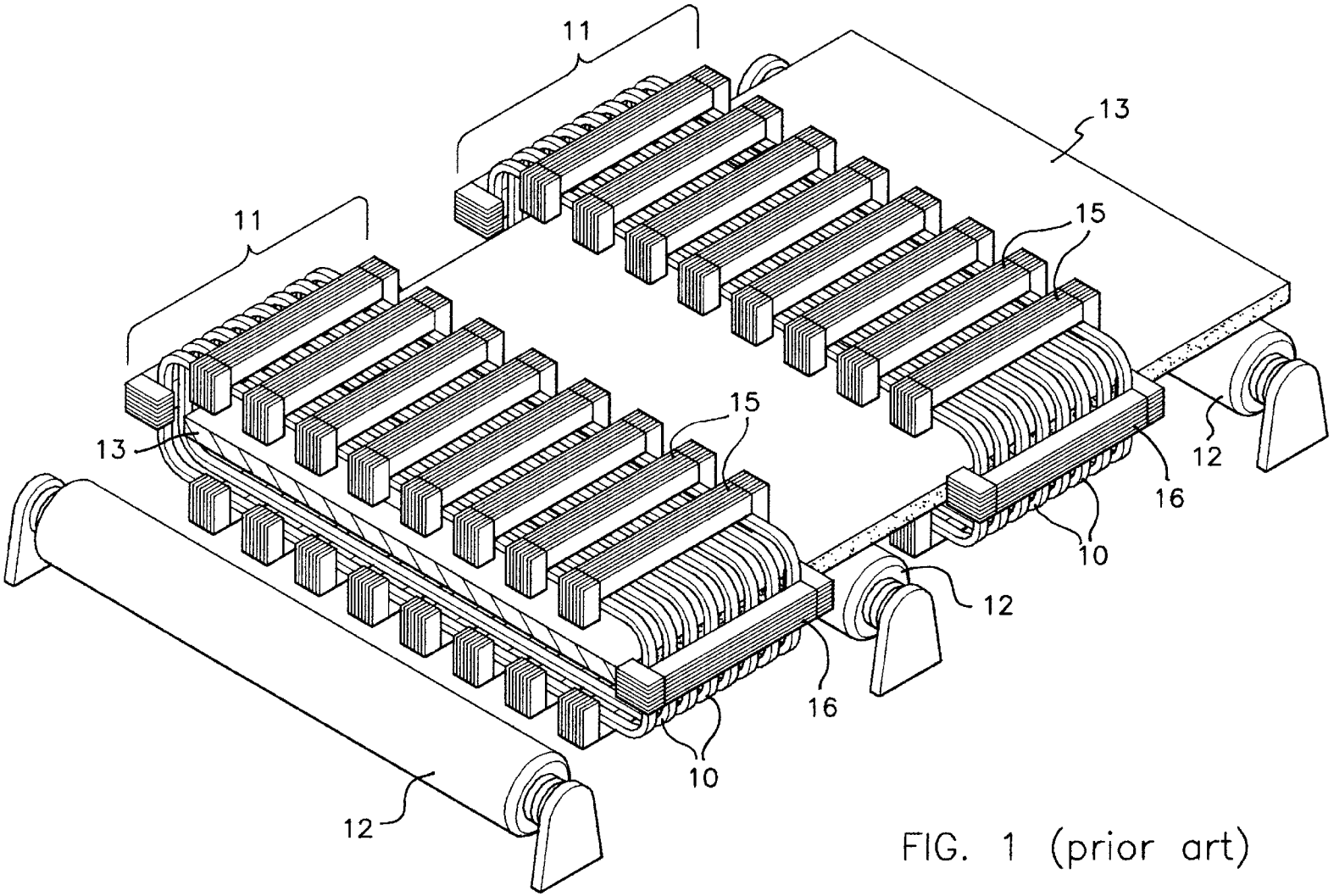
FIG. 1 (prior art)

In a typical induction furnace for use in a steel mill, a plurality of induction coils 10, FIG. 1, are grouped together into a plurality of induction coil modules 11. Each induction coil module is positioned between rollers 12 so that a steel slab, plate, or ingot 13 to be heated travels over the rollers 12 through the induction coils. The coils in each coil module are spaced apart by insulating material, not shown, positioned at intervals between the coils. An alternating electric current is passed through the coils, which generates magnetic flux around the coils. As the alternating current passing through the coils changes in direction and amplitude, the magnetic field generated by the coils changes also. The steel to be heated within the coils forms a resistive load in the magnetic field so that a current is induced in the steel. This induced current produces heat and causes heating of the steel.

In order to confine the magnetic field produced by current flow in the coils to the area inside the coils and prevent heating of the furnace supporting frame and housing outside the coils, magnetic shunts 15 made from laminated grain oriented electrical steel are positioned horizontally across the coils of each coil module above and below the coils. Vertical shunts 16, called yokes, are placed across the coils at the ends of the coil modules. The shunts 15 and yokes 16 extend substantially perpendicularly to the coils 10.

Figure 2:
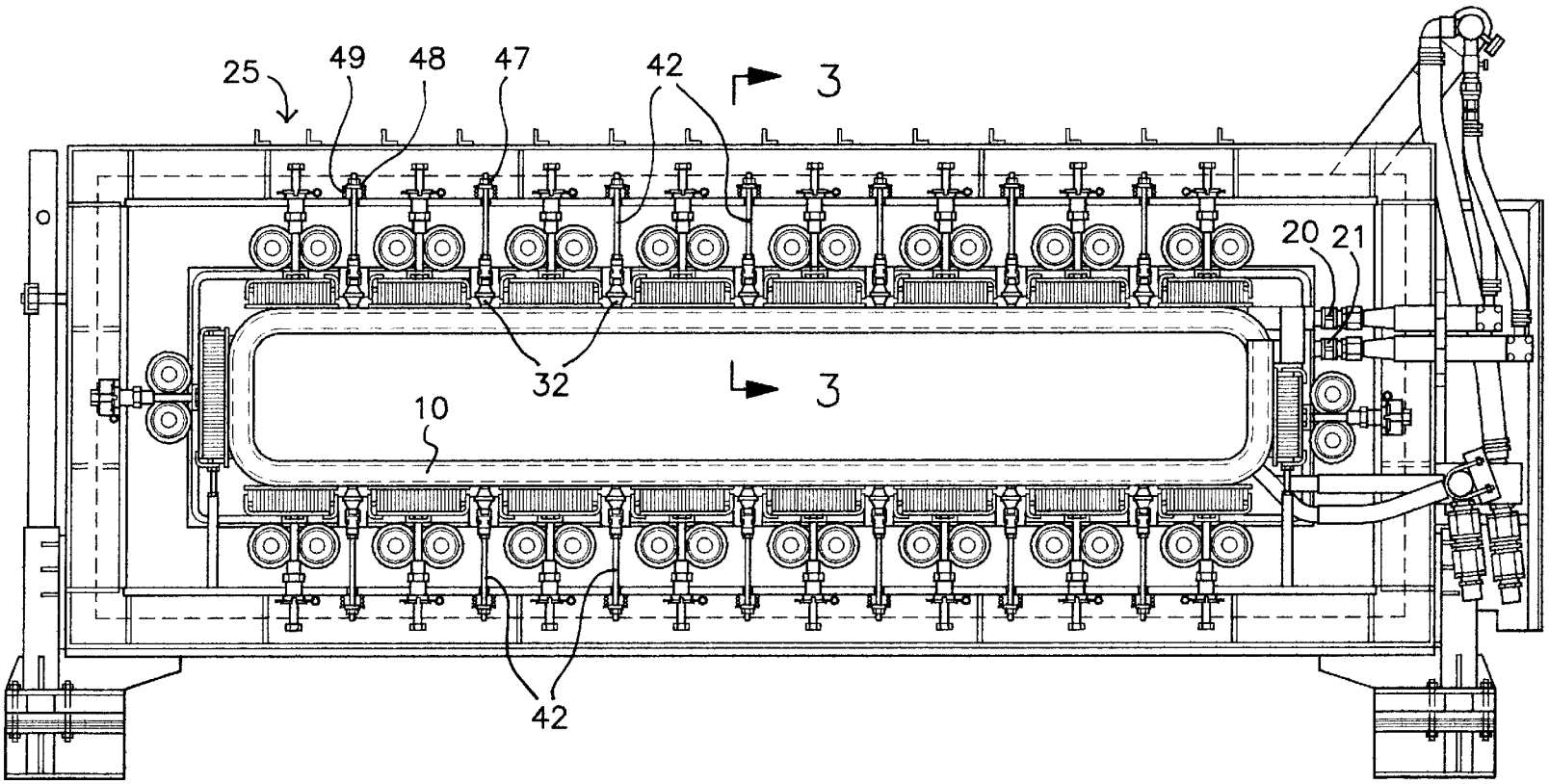
FIG. 2 (prior art)

The coils 10 are formed from heavy copper tubing which is strong enough to maintain its shape when supported in the furnace. The tubing provides a water passage 19, FIG. 3, therein for circulation of cooling water. Water inlets and outlets 20 and 21, respectively, FIG. 2, are connected through appropriate tubing in normal manner to provide water circulation.

In the normal induction furnace, a number of coil modules 11 will be positioned between successive rollers. While only two coil modules are shown in FIG. 1 for ease of illustration, usually induction furnaces for heating steel will have between about six and ten coil modules. The coil modules and rollers are supported and enclosed in a supporting frame and housing 25, FIGS. 2 and 3, which encloses and positions the coil modules with respect to the rollers and other components of the furnace. The housing is open at one end to receive slabs, plates, or ingots to be heated and open at the other end to discharge the heated slabs, plates, or ingots. Because the steel to be heated rolls along the rollers, it is important that each coil and coil module be supported accurately between the rollers so the steel to be heated passes through the coils and does not hit or rub the coils.

Figure 3:
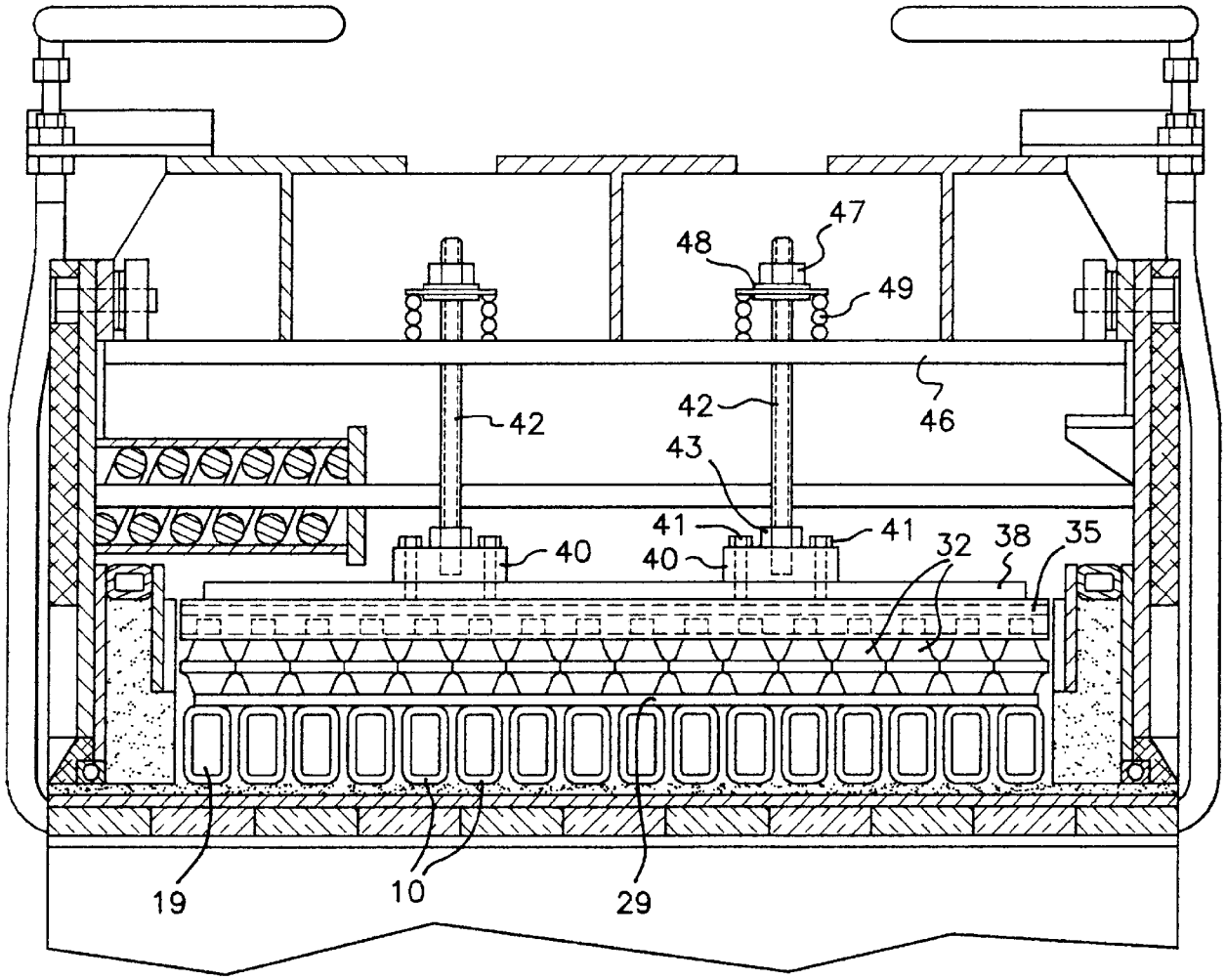
FIG. 3 (prior art)
Figure 4:
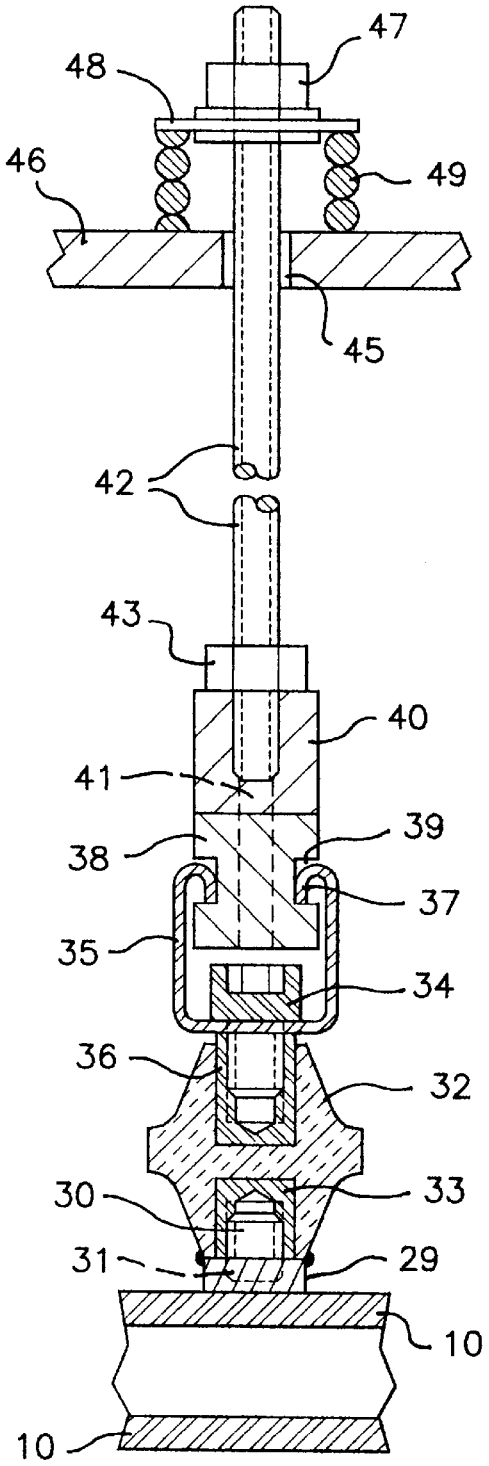
FIG. 4 (prior art)

It is currently common practice, at least for induction furnaces made by Inductotherm of Rancocas, N.J, to attach bars 29, FIG. 3, as by welding transversely across the coils 10 in a coil module 11 between the shunts 15. Studs 30, FIG. 4, are threaded into threaded holes 31 in bar 29, generally with a stud extending from bar 29 in line with each of the coils 10. An insulator 32 with threaded insert 33 is screwed onto each of the studs 30. A bolt 34 is passed through a piece of UNISTRUT or similar steel channel material 35 and screwed into threaded insert 36 in insulator 32. Channel 35 extends substantially perpendicularly to the coils in a coil module parallel to bars 29 and parallel to and between the shunts 15, with all coils of the module similarly secured to bar 29 and the channel material 35. Channel 35 has rolled edges 37 along the channel opening. A bar 38 with slots 39 is slid into channel material 35 and rod mount blocks 40 are attached to bar 38 such as by bolts 41. Rigid supporting rods 42 are threaded into rod mount blocks 40 with a locking nut 43 on the rod 42 to lock the rod into mounting block 40. The opposite end of supporting rod 42 passes through a hole 45 in the furnace housing 46 and is tightened in position by nut 47 and washers 48 against spring 49 which bears against housing 46. This is the conventional mounting system. Similar support rods similarly mounted are provided on opposite sides of the coil modules, i.e., on the top side and bottom side of the coil modules as shown in FIG. 2 and are tightened to securely position and hold the coil modules in proper position between the rollers in the furnace housing. The furnace construction shown and described so far is standard and well known by those skilled in the art. Therefore, other portions of the construction as shown in FIGS. 1–3 are not discussed in detail here.

It has been found that although this prior art mounting system for the coil module works fairly well for older furnaces, with new high power furnaces, the vibration of the coils and coil modules causes breakage of the studs extending into the insulators and of the channel material thereby allowing the coil modules to break loose in the furnace. When a coil module breaks loose, the furnace has to be shut down and repaired by again attaching the loose coil module to the furnace housing to hold it properly in position between the rollers.

The current invention is to provide flexible mounting members in place of the rigid rods 42 to secure the coil modules to the housing. Preferably these flexible mounting members take the form, of steel cables. Because the mounting members are provided on both, top and bottom sides of the coil modules (as shown for rods 42 in FIG. 2) and are tightened to securely support and hold the coil modules in the furnace housing, the use of the flexible support members does not adversely affect the positioning and holding of the coil modules within the furnace housing. The flexible support members absorb some of the vibration and other shock from the coil modules during furnace operation and failure of the mounting system is significantly reduced. This significantly reduces the amount of down time for the furnace and the amount of repair necessary.

Figure 5:
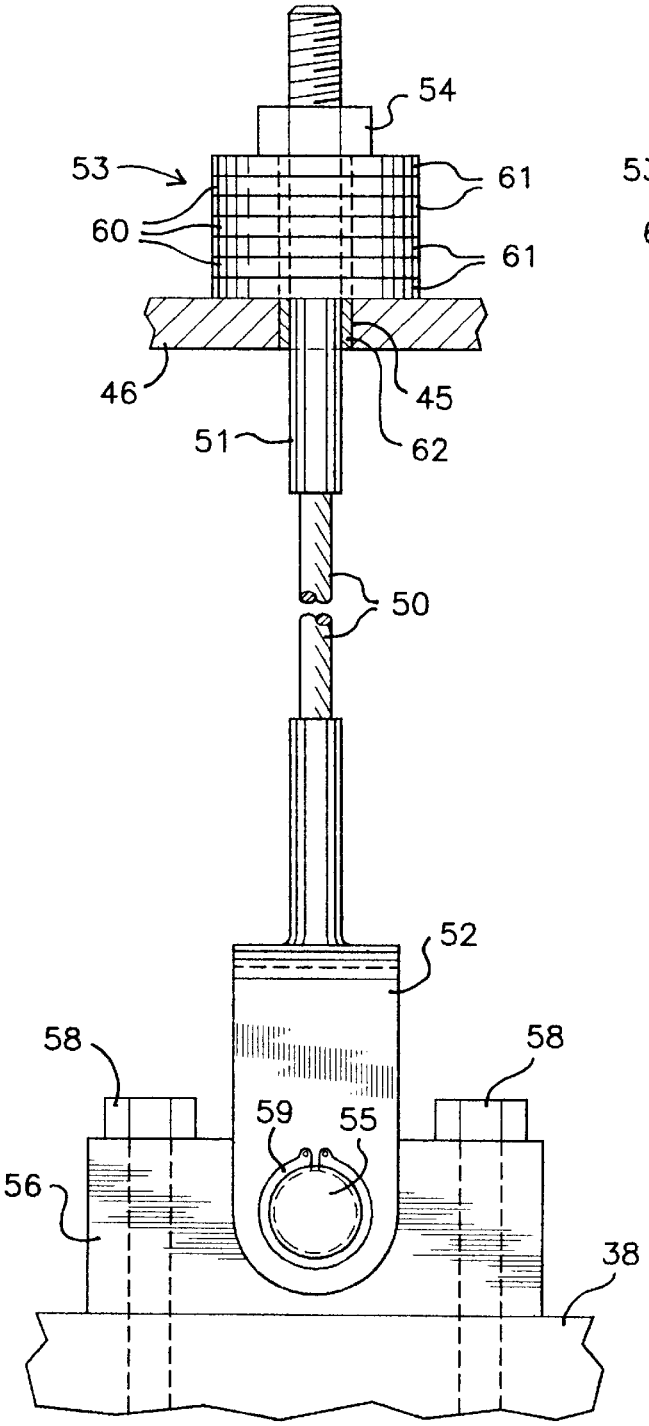
Figure 6:
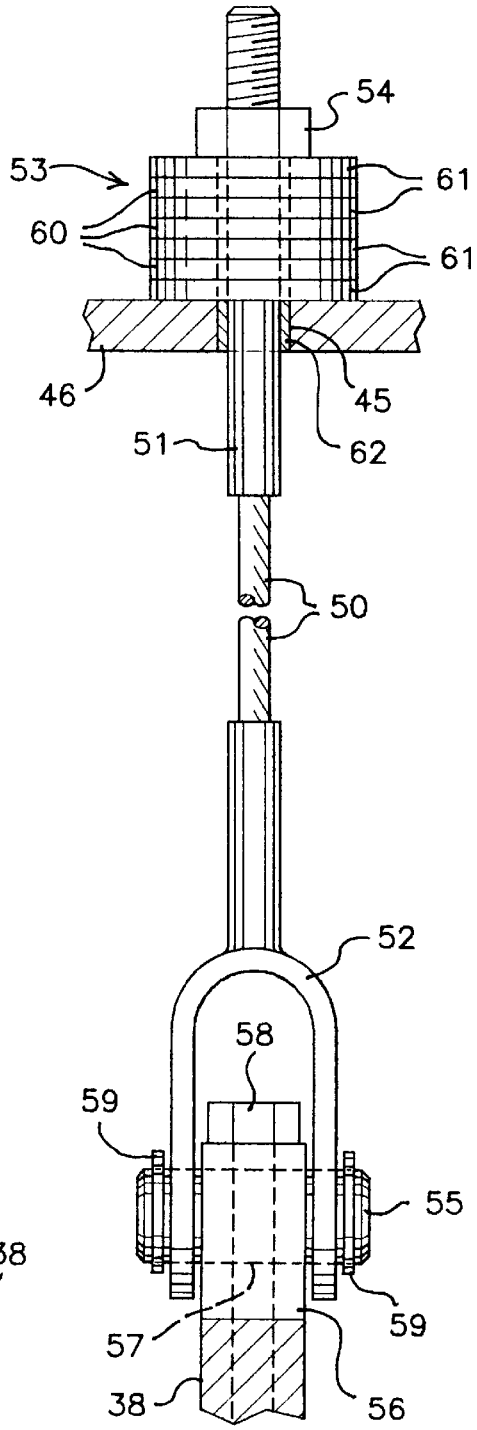

The preferred mounting member of the invention is a length of stainless steel or galvanized steel cable 50, FIGS. 5 and 6. A threaded rod 51 is swedged onto one end of the cable 50 while a clevis 52 is swedged to the other end of the cable 50. This cable assembly which forms the flexible mounting member, replace the rigid support rods 42, FIG. 2–4. The threaded rod extending from the cable extends through hole 45 in furnace housing 46. The end of the cable assembly could be secured to the housing in the same manner as the rod 42 is in FIG. 4 with a bolt, washer assembly, and spring, or may be secured with a special vibration absorbing washer 53 in conjunction with nut 54. The clevis 52 is secured by pin 55 to mounting block 56 having a receiving hole 57 therethrough for passage of pin 55 with mounting block 56 secured to bar 38 by bolts 58 similarly to mounting block 40 of FIG. 4. Pin 55 is held in place by snap rings 59.

Washer 53 is a combination of elastomeric material and steel plates. Steel plates or washers 60 are sandwiched between elastomeric material 61 such as a forty to sixty durometer hardness elastomeric rubber. Nut 54 tightens the washer 53 against housing 46. Preferably an insulating sleeve 62 is provided in the hole and through washer 53 to insulate threaded rod 51 from the furnace housing 46. A flexible mounting member of the invention replaces each of the support rods 42 of the conventional furnace.

While the invention has been described as using steel cable, other flexible materials could be used as long as such materials have the necessary strength to hold the coil modules in place and temperature characteristics to withstand the heat generated within the furnace housing. Also, depending upon the furnace construction, various means could be used to attach the support: members of the invention to the coil modules and to the furnace housing.

In the furnace illustrated in the drawings, the mounting member is about sixteen inches in overall length with the cables being about five and one-half inches in length. However, the length of the cable section is not critical with a cable section as short as about two inches providing the necessary reduction in shock absorption.

The invention also includes the method of reducing the failure rate of the mounting structure for mounting the induction coil modules in an induction furnace by replacing the normally rigid supporting rods used with flexible supporting or mounting members, Whereas this invention is here illustrated and described with reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A support member for induction coil modules used in induction furnaces wherein the induction coil modules are secured in a furnace housing, comprising a length of flexible material; means attached to one end of the flexible material for attachment to the furnace housing, said means including an elastomeric washer having layers of elastomeric material between layers of steel to be positioned against the housing; and means attached to the other end of the flexible material for attachment to an induction coil module.

2. The support member for induction coil modules used in induction furnaces according to claim 1, wherein the length of flexible material is a length of cable.

3. The support member for induction coil modules used in induction furnaces according to claim 2, wherein the means attached to one end of the flexible material for attachment to the furnace housing is a threaded rod secured to one end of the cable.

4. The support member for induction coil modules used in induction furnaces according to claim 3, wherein the means at the other end of the flexible material for attachment to an induction coil module is a clevis secured to the other end of the cable.

5. The support member for induction coil modules used in induction furnaces according to claim 3, wherein the support member is adapted to be attached to the furnace housing by a nut screwed on the threaded rod with the elastomeric washer between the nut and the housing.

6. The support member for induction coil modules used in induction furnaces according to claim 1, wherein the elastomeric material has a durometer between about forty and sixty.

7. The support member for induction coil modules used in induction furnaces according to claim 1, wherein the means at the other end of the flexible material for attachment to an induction coil module is a clevis secured to the said other end of the flexible material.

8. In an induction furnace wherein the furnace includes a furnace housing, a plurality of induction coil modules, and substantially rigid support rods mounting the induction coil modules in the furnace housing, the improvement comprising replacing the substantially rigid support rods with flexible support members.

9. The improvement in induction furnaces according to claim 8, wherein the flexible support members include a length of flexible cable.

10. The improvement in induction furnaces according to claim 9, wherein one end of the flexible support members are secured to the furnace housing, and wherein each flexible support member includes a threaded rod which extends through a receiving opening in the furnace housing and the flexible support member is held in place with respect to the furnace housing by a nut on the threaded rod.

11. The improvement in induction furnaces according to claim 10, wherein an elastomeric washer is positioned between the nut and the furnace housing.

12. The improvement in induction furnaces according to claim 11, wherein the elastomeric washer includes layers of steel between layers of elastomeric material.

13. The improvement in induction furnaces according to claim 11, wherein one end of the flexible support members are secured to the induction coil module, and wherein each flexible support member includes a clevis which is secured to a receiving bracket of the coil module by a connecting pin.

14. A method of reducing the failure rate of the mounting structure mounting induction coil modules in an induction furnace wherein the mounting structure includes rigid support rods, comprising the step of replacing the rigid support rods with flexible mounting members.

15. A method according to claim 14 wherein the step of replacing the rigid support rods with flexible mounting members comprises the step of replacing the rigid support rods with mounting members including a length of flexible cable.

* * * * *